US009986847B2

(12) United States Patent
Tanaka

(10) Patent No.: US 9,986,847 B2
(45) Date of Patent: Jun. 5, 2018

(54) CHAIR ELBOW REST COVER MEMBER AND CHAIR HAVING THE SAME

(71) Applicant: NAM CORPORATION, Osaka (JP)

(72) Inventor: Nobuyoshi Tanaka, Osaka (JP)

(73) Assignee: NAM CORPORATION, Osaka (JP)

( * ) Notice: Subject to any disclaimer, the term of this patent is extended or adjusted under 35 U.S.C. 154(b) by 0 days. days.

(21) Appl. No.: 14/847,175

(22) Filed: Sep. 8, 2015

(65) Prior Publication Data

US 2017/0065096 A1 Mar. 9, 2017

(51) Int. Cl.
*A47C 31/11* (2006.01)
*A47C 7/54* (2006.01)

(52) U.S. Cl.
CPC ..... *A47C 31/11* (2013.01); *A47C 7/54* (2013.01)

(58) Field of Classification Search
CPC ..... A47C 31/11; A47C 7/54; A47C 31/113; B60N 2/60; B60N 2/6009
USPC ..... 297/227, 228, 225
See application file for complete search history.

(56) References Cited

U.S. PATENT DOCUMENTS 1,825,909 A * 10/1931 Levi ..... A47C 31/11 297/224
2,254,466 A * 9/1941 Albert ..... A47D 1/008 297/225
RE24,279 E * 2/1957 Schutte et al. ..... A47C 31/11 297/227
2,828,812 A * 4/1958 Buford ..... A47C 31/11 297/228
2,871,924 A * 2/1959 Trubitt ..... A47C 31/11 297/228
2,937,695 A * 5/1960 Coggin ..... A47C 31/11 297/225
4,262,962 A * 4/1981 Yust ..... A47C 7/70 297/145
5,505,412 A * 4/1996 Van Hamme ..... A47C 7/546 248/118
5,887,940 A * 3/1999 Anderson ..... A47C 7/70 108/157.11
6,817,663 B1 * 11/2004 Stuart ..... A47D 15/006 297/219.1
7,959,227 B2 * 6/2011 Miller ..... A47C 31/11 297/224
8,733,837 B2 * 5/2014 Weinstein ..... A47C 31/113 297/228
2003/0042774 A1 * 3/2003 Hackett ..... A47C 31/11 297/227
2008/0252119 A1 * 10/2008 Miller ..... A47C 31/11 297/224
2010/0140994 A1 * 6/2010 Moore ..... A47C 31/11 297/227
2011/0198904 A1 * 8/2011 Thomas ..... A61G 5/10 297/227
2013/0187420 A1 * 7/2013 Weinstein ..... A47C 31/113 297/227
2014/0145478 A1 * 5/2014 Boston ..... A61G 5/02 297/188.18

(Continued)

*Primary Examiner* — Milton Nelson, Jr.
(74) *Attorney, Agent, or Firm* — Wenderoth, Lind & Ponack, L.L.P.

(57) ABSTRACT

A cover member for an elbow rest of a chair includes a mounting portion to be disposed along an upper surface of the elbow rest, and a concealing portion for covering a side portion of the elbow rest. The mounting portion is to be hooked and stopped on the elbow rest.

19 Claims, 7 Drawing Sheets

(56) References Cited

U.S. PATENT DOCUMENTS

| | | | | |
|---|---|---|---|---|
| 2014/0223666 | A1* | 8/2014 | Pavlin | A47C 27/15 5/727 |
| 2014/0265483 | A1* | 9/2014 | Miller | A47C 31/11 297/228 |

* cited by examiner 3
1
31

3
11
31
1
12

1
31
4
4

3
11
31
1
12

1
31
4

11
L11
11

11
11
L11

11
31
1
12

CHAIR ELBOW REST COVER MEMBER AND CHAIR HAVING THE SAME

TECHNICAL FIELD

The present invention relates to a cover member of a chair elbow rest and a chair having such a member.

BACKGROUND ART

Conventionally, chairs generally used as office furniture are often provided with elbow rests, but these elbow rests are often mounted on a seat side by way of support members.

Accordingly, in chairs of this type, a wide space is formed between the elbow rest and the seat side of the chair, and air communicates through this space, cools the body of the occupant, and reveals the clothes of the occupant, and it was necessary to pay attention to the state of the occupant's clothes.

On the other hand, for the purpose of heat insulation, a lap cover was used, but when such a lap cover is used alone, it is likely to slip down, and a length of the chair lap cover of this type is often shorter than a length from a front end of the seat to a rear end of the seat, and when not in use, the lap cover droops down to touch the floor, and the lap cover is stained.

PROBLEMS TO BE SOLVED BY THE INVENTION

Summary of the Invention

The present invention is devised to solve the problems of the chair provided with the conventional elbow rest, and it is a primary object thereof to present a cover member of an elbow rest of a chair and a chair having such member, so as to solve the problems derived from the space formed between the elbow rest and the seat.

It is hence a secondary object thereof to present a cover member of a lap portion of a chair and a chair having such member, so as to solve the problems in the case of using the lap cover.

Means for Solving the Problems

To achieve the primary object, the elbow rest cover member of the chair of the present invention includes a mounting portion to be mounted on the topside of the elbow rest and fastened to the elbow rest of the chair, and a concealing portion for concealing the side portion of the elbow rest.

In this case, the length of the mounting portion comes to be equivalent to the length from the front end of the seat the rear end of the seat.

At the same time, the length of the mounting portion is variable.

To achieve the secondary object, the elbow rest cover member of the chair of the present invention includes a lap cover portion made of a sheet member to wrap a lap portion in a position on the chair, in which the sheet member of the lap cover portion is integrated with the mounting portion or the concealing portion.

To achieve the secondary object, the elbow rest cover member of the present invention has the concealing portion for covering the side portion of the elbow rest and a lap cover member of a sheet material so as to envelop the lap portion on the seat.

To achieve the primary and secondary objects, the chair of the present invention has a cover member of the elbow rest of the chair.

Effects of the Invention

According to the cover member of the present invention, comprising a mounting portion being mounted along the top surface of the elbow rest and being fastened to the elbow rest, and a concealing portion for covering and concealing the side portion of the elbow rest, by a member easily mounted on the elbow rest, the space formed between the elbow rest of the chair and the seat surface is covered, and air communicates through this space, so that the clothes of the occupant are prevented from being seen through, and the problem caused by the space formed between the elbow rest and the seat surface may be solved.

In addition, since the length of the mounting portion comes to be equivalent to the length from the front end of the seat to the rear end of the seat, the problem attributable to the space formed between the elbow rest and the seat surface can be more definitively eliminated.

Besides, since the length of the mounting portion is variable, it is applicable to chairs of various sizes.

According to the cover member of the present invention, it includes a lap cover portion made of a sheet member to wrap the lap portion in a position on the chair, and the sheet member of the lap cover portion is integrated with the mounting portion or the concealing portion, or the concealing portion for covering the side portion of the elbow rest is made of the lap cover member made of a sheet material formed to envelop the lap part in a state on the chair, and therefore the problems when using the lap cover may be solved by preventing the lap cover from slipping down, or the drooping portion down from the lap cover when not in use from contacting the floor or the lap cover from staining.

The chair of the invention therefore is capable of solving the problems derived from the space formed between the elbow rest and the seat surface or the problems when using the lap cover.

BRIEF DESCRIPTION OF THE DRAWINGS

FIG. 1 shows a cover member of an elbow rest of a chair of the present invention and an exemplary embodiment of the chair having the same member, in which

FIG. 2 shows a cover member of an elbow rest of a chair of the present invention and an exemplary embodiment of the chair having the same member, in which

FIG. 5 shows various embodiments of the cover member of the elbow rest of the chair and the chair including the same member, in which

BEST MODE OF CARRYING OUT THE INVENTION

Embodiments of the cover member of the elbow rest of the chair of the invention and the chair having such member are described below by reference to the accompanying drawings.

FIG. 1 to FIG. 4 show embodiments of the cover member of the elbow rest of the chair of the present invention.

Figure 1D:
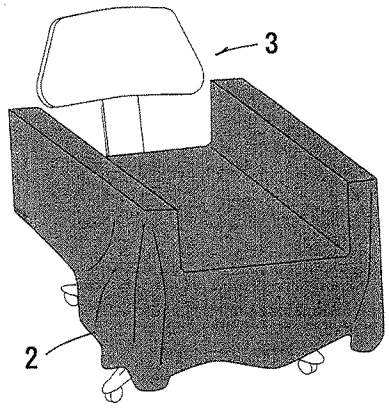
FIG. 1D is a perspective view of the chair including the cover member of the elbow rest of the chair having the lap cover.
Figure 1B:
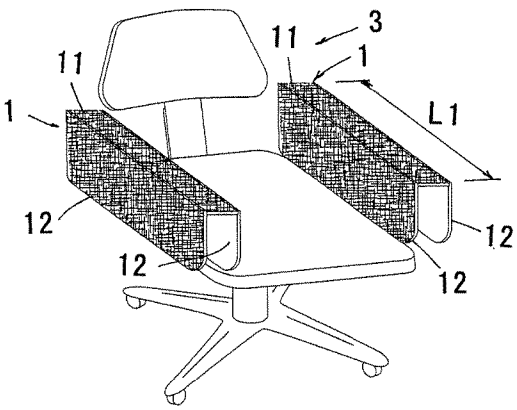
FIG. 1B is a perspective view of the chair including the cover member of the elbow rest of the chair.
Figure 1A:
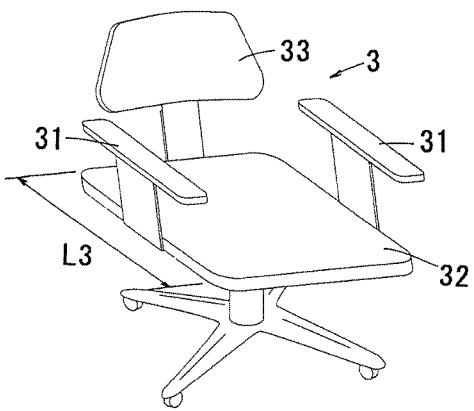
FIG. 1A is a perspective view of the chair including the cover member of the elbow rest of the chair.

As shown in FIG. 1B, the cover member 1 of the elbow rest of the chair comprises a mounting portion 11 to be disposed along the top side of the elbow rest 31 and hooked and fastened to the elbow rest 31 of the chair 3, and a concealing portion 12 for covering the side portion of the elbow rest 31.

In this case, the mounting portion 11 of the cover member 1 is composed of a plastic plate (bar or pipe), a synthetic resin material such as plastic corrugated cardboard, an aluminum plate (bar or pipe) or other metal material, or a rigid plate member (bar or pipe) such as corrugated cardboard or thick paper.

Figures 2A, 2B, 2C, 2D, 2E, 2F, 2G, 2H:
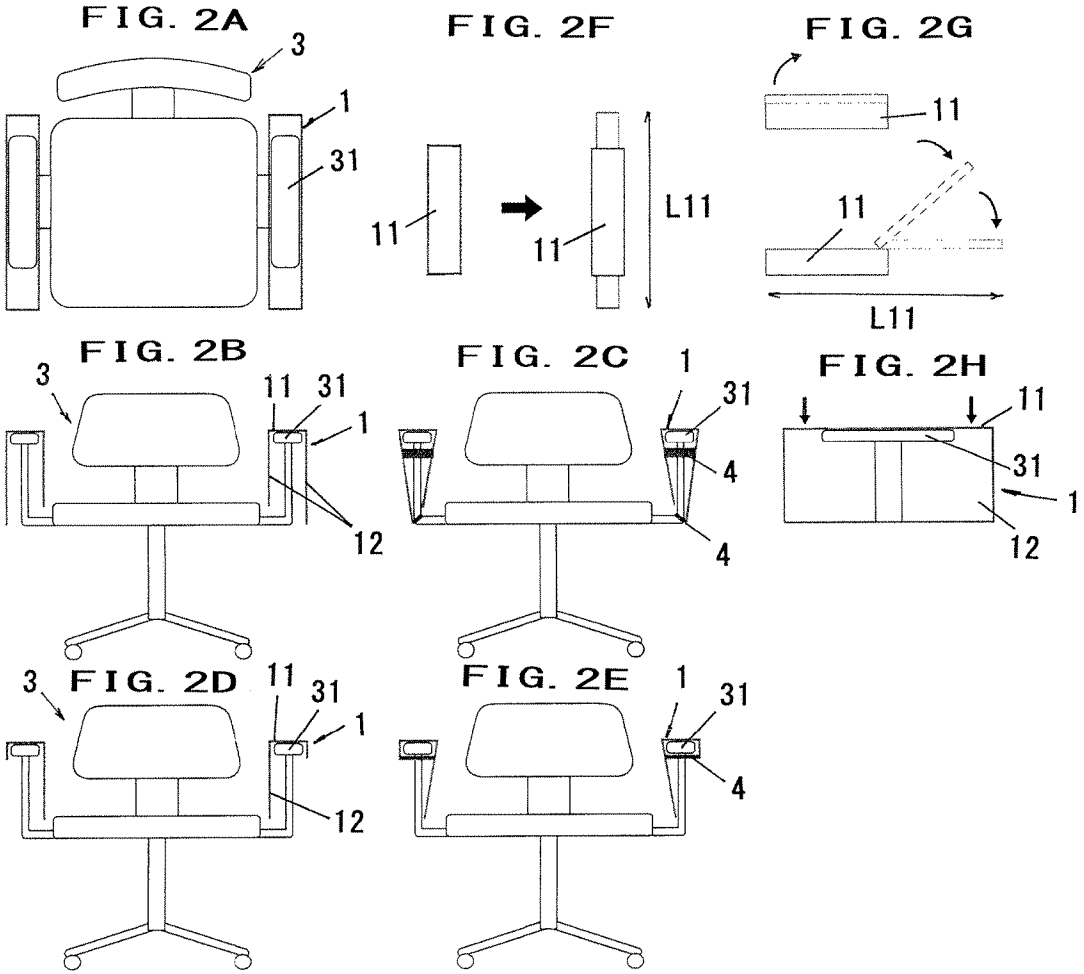
FIG. 2A is a plan view of the chair including the cover member of the elbow rest of the chair.
FIG. 2B is a front view thereof.
FIG. 2C is a front view showing a state of the cover member of the elbow rest of the chair being mounted on the chair.
FIG. 2D is a front view of a modified example of the same.
FIG. 2E is a front view showing a state of the cover member of the elbow rest of the chair of the modified example being mounted on the chair, being a perspective view of the chair including the cover member of the elbow rest of the chair.
FIG. 2F is a plan view of a modified example of the cover member of the elbow rest of the chair.
FIG. 2G is a side view of a modified example of the cover member of the elbow rest of the chair.
FIG. 2H is a side sectional view of the elbow rest of the chair including the cover member of the elbow rest of the chair.

Herein, the required rigidity of the mounting portion 11 of the cover member 1 is formed as shown in FIG. 2H, that is, the mounting portion has enough strength so that the mounting portion 11 may not be folded or deformed, when an elbow is placed on a portion of the mounting portion 11 extended back or forward from the elbow rest 21.

Herein, the mounting portion 11 of the cover member 1 is basically made of a rigid member, or a member of a rubber elastic body having a restoring property.

Figure 1E:
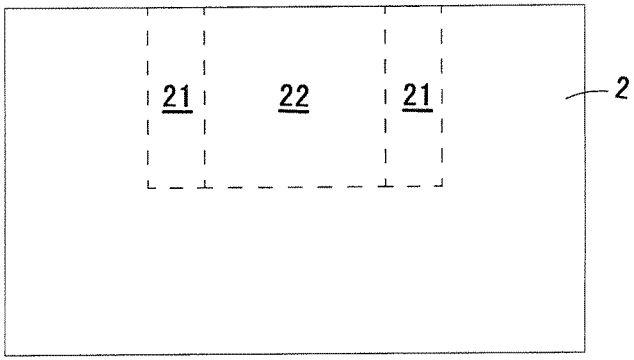
FIG. 1E is a plan view showing a developed state of the lap cover.
Figure 1C:
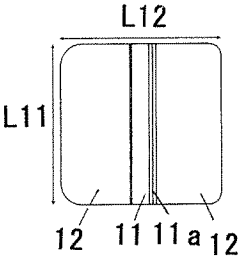
FIG. 1C is a plan view showing a developed state of the cover member of the elbow rest of the chair.

The cover member 1 is formed as shown in FIG. 1C, that is, a plurality of foldable lines 11*a* are formed along the mounting portion 11, and folded and mounted at a position of the foldable lines 11*a* corresponding to the width of the elbow rest 31 to be mounted.

Accordingly, it is applicable to the chair 3 of various sizes depending on the width of the elbow rest 31.

Of the cover member 1, at least the mounting portion 11 is preferably formed in a length L11 (usually about 400 to 450 mm) corresponding to the length L3 from the front end of the seat part 32 to the rear end of the seat part 32 of the chair 3.

Of the cover member 1, at least the mounting portion 11 can be formed so as to be various in its length L11.

The mechanism for varying the length L11 of the mounting portion 11 is, for example as shown in FIG. 2F, that is, the length L11 is variable by sliding, or as shown in FIG. 2G, the length L11 may be variable by developing the folded members.

In this manner, it is possible to correspond to chairs 3 of various sizes.

Figure 5A:
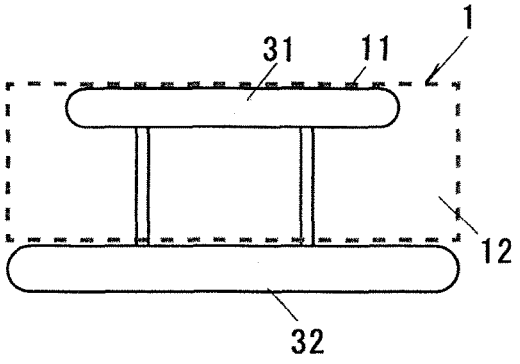
FIG. 5A is a side sectional view (without height adjusting member) of the elbow rest portion of the chair including the cover member of the elbow rest of the chair.
Figure 5B:
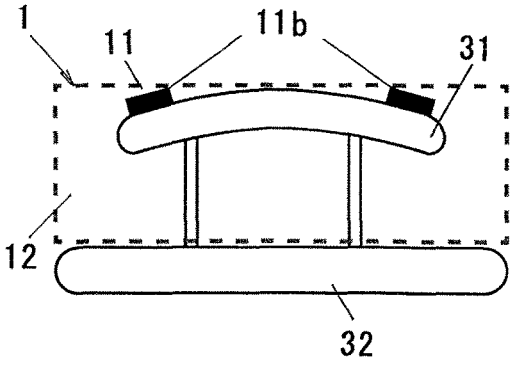
FIG. 5B is a side sectional view (with height adjusting member) of the elbow rest portion of the chair including the cover member of the elbow rest of the chair.

The top side of the elbow rest 31 of the chair 3 is usually horizontal as shown in FIG. 5A, but if not horizontal as shown in FIG. 5B, as required, a height adjusting member 11*b* may be disposed between the mounting portion 11 and the elbow rest 31 beforehand so that the mounting portion 11 of cover member 1 may be inserted stably in a horizontal state.

Figure 6A:
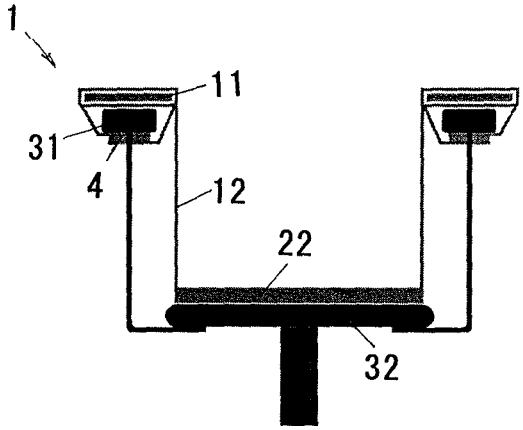
FIG. 6 shows various embodiments of the cover member of the elbow rest of the chair and the chair including the same member, being front sectional views of the chair including the cover member of the elbow rest of the chair.
Figure 6B:
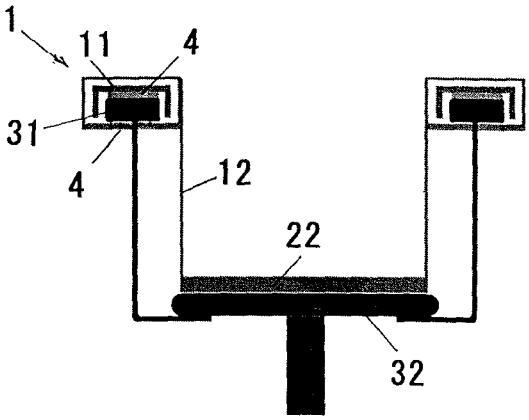

The concealing portion 12 of the cover member 1 may be formed either integrally by using a same material as the mounting portion 11, or as shown in modified embodiments in FIG. 6A and FIG. 6B, it may be also possible to use a knit cloth, woven cloth, blanket, or nonwoven cloth, or a comparative elastic material such as plastic sheet, foamed plastic sheet, or synthetic resin, or in any case by using fixing means such as a surface fastener, braiding material, hook, button, magnet, adhesive, or any desired affixing member, it may be composed by integrally affixed to the mounting portion 11 (in this case, by cover the mounting portion 11.

Consequently, as shown in FIG. 1C, the cover member 11 at the side of the elbow rest 31 may be covered with the concealing portion 12 of the cover member 1 from both inner and outer sides, and when formed integrally by using a same material as the mounting portion 11, the developed width dimension 12 of the cover member 1 is set to a sum of the width dimension of the elbow rest 31, and a double of the height dimension from the elbow rest 31 to the seat part 32 of the chair 3 (usually about 450 to 500 mm).

In this embodiment, therefore, as shown in FIG. 1, FIG. 2B and FIG. 2C, FIG. 3A and FIG. 4A, the concealing portion 12 of the cover member 1 is formed to cover the side portion of the elbow rest 31 from both sides, but as shown in FIG. 2D and FIG. 2E, it may be also formed to cover the side portion of the elbow rest 31 only from the inner side, or to cover only from the outer side (not shown).

In any case, by using any arbitrary affixing member or affixing means such as a surface fastener, braiding member, hook, button, magnet, or adhesive, mutually opposing portions 12 (mutual mounting portions 11) and/or concealing portions 12 (mounting portions 11) and the chair 3 are fixed, so that the cover member 1 may be affixed to the elbow rest 31 of the chair 3.

The cover member 1 of the elbow rest of the chair may be either provided with the lap cover portion 2 explained below, or may be used alone.

Therefore, in order that the cover member 1 may be used also in an exposed state, it is preferred to compose the cover member by using a fashionable member suited to the application of the chair or the place of installation.

Accordingly, by a member easily inserted in the elbow rest 31 of the chair 3, the space formed between the elbow rest 31 of the chair 3 and the seat is covered, and for example, prevents the clothes of the occupant from being seen, and it is possible to solve problems derived from the space formed between the elbow rest 31 and the seat, such as cooling of the body due to passage of air or exposure of the clothes of the occupant or necessity of consideration of the state of the clothes.

Moreover, the cover member 1 of the elbow rest of the chair is provided with a lap cover portion 2 made of a sheet material so as to wrap the lap area in a state on the chair, as shown in FIG. 1D and FIG. 1E, and the sheet material of the lap cover portion 2 may be formed integrally by using the mounting portion 11 or the concealing portion 12 of the cover member 1, the surface fastener, braiding member, hook, button, magnet, or adhesive, arbitrary affixing member or affixing means 4.

Thereby, it is possible to prevent slipping of the lap cover portion 2, contacting of the drooping portion of the lap cover portion 2 with the floor while not in use so as to contaminate the lap cover portion 2, or other problems caused when using the lap cover.

The sheet material for composing the lap cover portion 2 may be preferably selected from thick woven cloth, knit cloth, blanket, nonwoven cloth, or other humidity retaining cloth, plastic sheet, foamed plastic sheet, or other synthetic rubber resin.

The sheet material for composing the lap cover portion 2 is set in a rectangular shape measuring about 900 to 1000 mm×1500 to 1700 mm as shown in FIG. 1E.

In the seat portion 22 of the sheet material for composing the lap cover portion 2, a cushioning member (padded seat) may be assembled, or without forming the seat portion 22 in the lap cover portion 2, it may be divided into right and left sections to be formed separately.

Figure 3A:
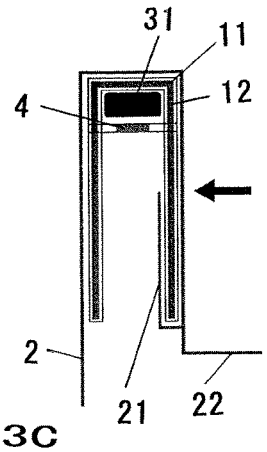
FIG. 3 shows various embodiments of the cover member of the elbow rest of the chair and the chair including the same member, being front sectional views of the elbow rest portion of the chair including the cover member of the elbow rest of the chair.
Figure 3B:
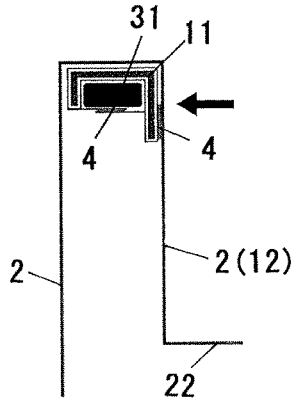
Figure 3C:
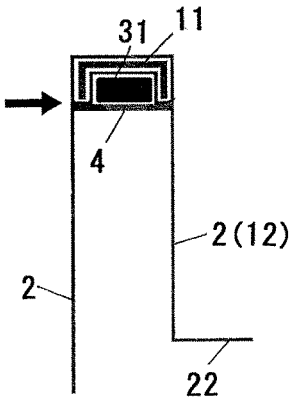
Figure 3D:
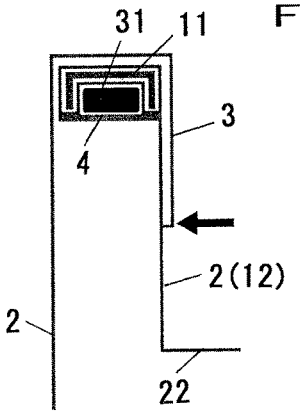
Figure 3E:
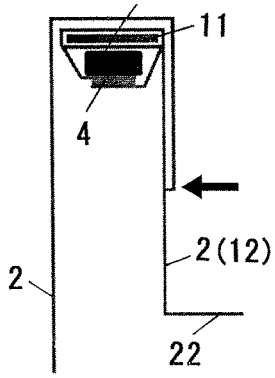
Figure 3F:
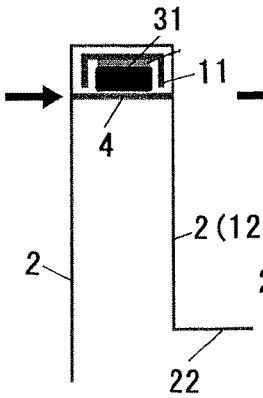
Figure 3G:
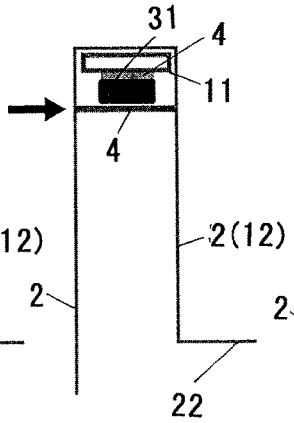
Figure 3H:
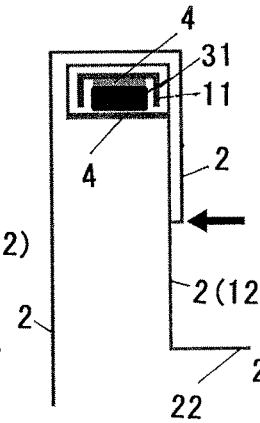
Figure 3I:
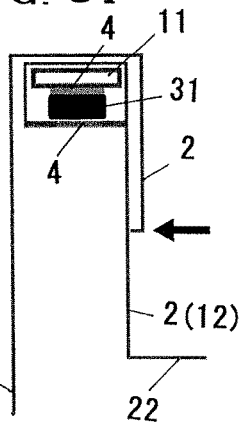
Figure 4A:
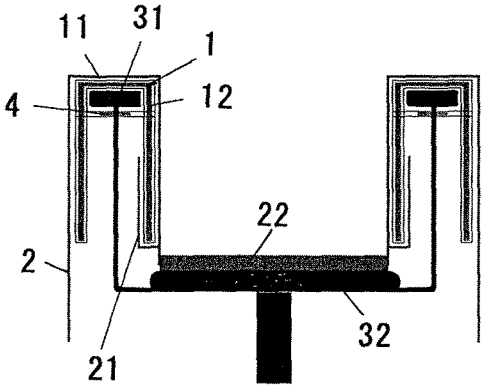
FIG. 4 shows various embodiments of the cover member of the elbow rest of the chair and the chair including the same member, being front sectional views of the chair including the cover member of the elbow rest of the chair.

Herein, the sheet material of the lap cover portion 2 is used as means for integrating with the mounting portion 11 or the concealing portion 12 of the cover member 1, and in this embodiment, as shown in FIG. 1E, FIG. 3A and FIG. 4A, a bag portion 21 for inserting the concealing portion 12 at the inner side of the cover member 1 is formed in the lap cover portion 2, so that the lap cover portion 2 may be held in the concealing portion 12, and the upper end (the position indicated by arrow in FIG. 3A) of the bag portion 21 is set free at the free end side of the lap cover portion 12 (similarly in FIG. 3B to FIG. 3I, wherein the free position of the free end side of the lap cover portion 2 is indicated by an arrow. Herein, the free position of the free end side of the lap cover portion 2 is set at a lower position than the middle point of the concealing portion 12 of the cover member 1, preferably from the viewpoint of heat insulation).

As the means for integrating the sheet material of the lap cover portion 2 with the mounting portion 11 or the concealing portion 12 of the cover member 1, aside from this example, as shown in FIG. 3B to FIG. 3I, the concealing portion 12 of the cover member 1 may be used commonly with the sheet material for composing the lap cover portion 2 (partly the sheet material is formed in a two-layer structure).

Further, as shown in FIG. 4B to FIG. 4E, it may be also possible to prepare another lap cover member 2A.

Figure 4B:
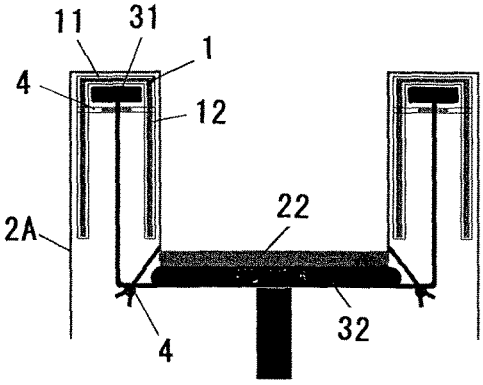
Figure 4C:
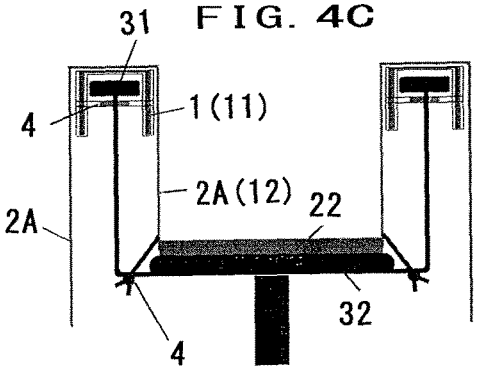
Figure 4D:
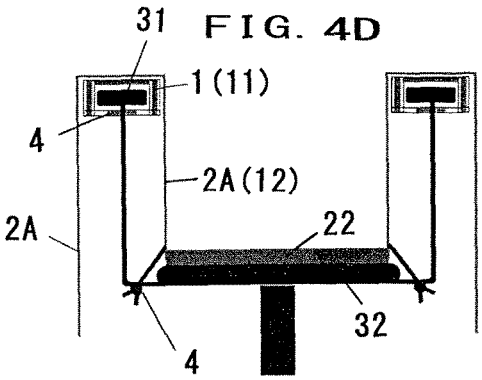
Figure 4E:
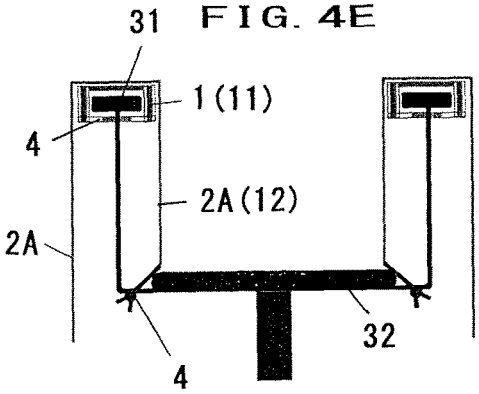

In this case, as shown in FIG. 4C to FIG. 4E, the concealing portion 12 for covering the side portion of the elbow rest 31 may be also formed from the lap cover member 2A using a sheet material so as to wrap the lap portion in a state on the chair.

The sheet material for composing the lap cover member 2A may be preferably made from, same as the lap cover portion 2, thick woven cloth, knit cloth, blanket, nonwoven cloth, or other humidity retaining cloth, plastic sheet, foamed plastic sheet, or other synthetic rubber resin.

Alternatively, as shown in FIG. 4B to FIG. 4D, in the seat portion 22 of the sheet material for composing the lap cover member 2A, a cushioning member (padded seat) may be incorporated, or as shown in FIG. 4E, or without forming the seat portion 22 in the lap cover member 2A, it may be divided into right and left sections to be formed separately.

Figure 7A:
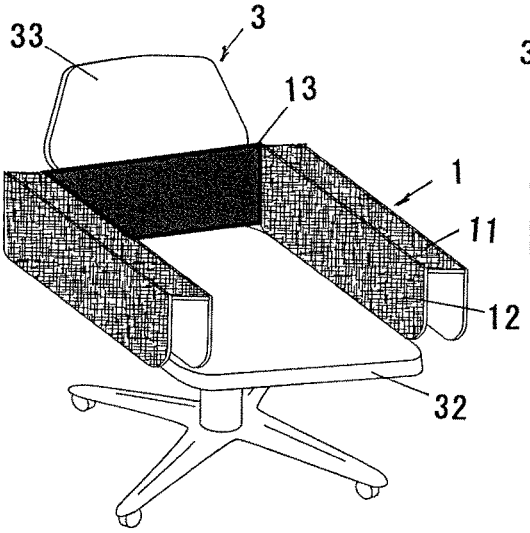
FIG. 7 shows various embodiments of the cover member of the elbow rest of the chair and the chair including the same member, being perspective views of the chair including the cover member of the elbow rest of the chair.
Figure 7B:
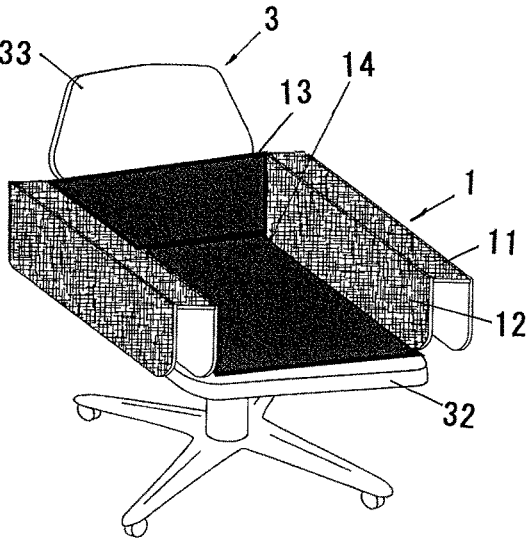

The cover member 1 of the elbow rest of the chair is, as shown in FIG. 7A, provided by forming an extension portion 13 by extending the concealing portion 12 of the cover portion 12 of the cover member 1 up to the position of the back rest 33 of the chair 3, or as shown in FIG. 7B, by forming an extension portion 14 in addition up to the position of the seat 32 of the chair 3.

As a result, by covering the space formed between the back rest 33 of the chair 3 and the seat, passing of the air or disclosure of the clothes of the occupant through this space can be prevented, and it is possible to solve problems derived from the space formed between the back rest 33 and the seat, such as problems of cooling of the body due to passing of air, or necessity of consideration of the state of the clothes due to disclosure of the clothes of the occupant.

Herein, the cover member of the chair of the invention and the chair comprising such member are specifically described by referring to plural embodiments, but the invention is not limited to these illustrated embodiments alone, but may be realized by properly combining the structures disclosed in the embodiments or by varying the structures appropriately within a range not departing from the true spirit thereof.

INDUSTRIAL APPLICABILITY

The cover member of the invention and the chair comprising such member are capable of solving the problems due to the space formed between the elbow rest and the seat and problems occurring when using such lap rest, and hence can be used with/as chairs in various applications such as office use or chairs of various applications.

DESCRIPTION OF REFERENCE NUMERALS

1 Cover member
11 Mounting portion
12 Concealing portion
2 Lap cover
2A Lap cover member
3 Chair
31 Elbow rest
4 Affixing member or affixing means

The invention claimed is:

1. A cover member for an elbow rest of a chair, the cover member comprising:

a mounting portion to be disposed along an upper surface of the elbow rest and to be hooked on the elbow rest, and a concealing portion for covering a side portion of the elbow rest, wherein the concealing portion includes a lap cover including a sheet material for wrapping a lap portion of the chair, and wherein the mounting portion is a rigid member.

2. The cover member according to claim 1, further comprising a height adjusting member, wherein the height adjusting member is to be disposed between the mounting portion and the elbow rest.

3. The cover member according to claim 1, wherein a length of the mounting portion is variable.

4. The cover member according to claim 1, wherein the rigid member is a plastic plate.

5. The cover member according to claim 1, wherein the rigid member includes corrugated cardboard.

6. The cover member according to claim 1, wherein the rigid member includes paper.

7. The cover member according to claim 1, wherein the rigid member is a bar.

8. The cover member according to claim 1, wherein the rigid member is a pipe.

9. The cover member according to claim 1, further comprising a fastener, wherein the mounting portion is fixed to the concealing portion by the fastener.

10. The cover member according to claim 1, wherein the rigid member includes a synthetic resin material.

11. The cover member according to claim 10, wherein the synthetic resin material is plastic corrugated cardboard.

12. The cover member according to claim 1, wherein the rigid member is a metal plate.

13. The cover member according to claim 12, wherein the metal plate is an aluminum plate.

14. A chair comprising the cover member according to claim 1 and an elbow rest.

15. The chair according to claim 14, wherein the mounting portion is fastened to the elbow rest.

16. The chair according to claim 14, further comprising:

a seat; and a support member, wherein the elbow rest is mounted to the seat by the support member.

17. The chair according to claim 14, wherein the cover member further comprises a height adjusting member, and the height adjusting member is disposed between the mounting portion and the elbow rest.

18. The chair according to claim 14, further comprising a seat, wherein a length of the mounting portion is equivalent to a length from a front end of the seat to a rear end of the seat.

19. A cover member for an elbow rest of a chair, the cover member comprising:

a mounting portion to be disposed along an upper surface of the elbow rest and to be hooked on the elbow rest, a concealing portion for covering a side portion of the elbow rest, and a lap cover including a sheet material for wrapping a lap portion of the chair, wherein the sheet material is integrated with the mounting portion or the concealing portion, and wherein the mounting portion is a rigid member.

* * * * *